US006026263A

United States Patent [19]

Nakahata et al.

[11] Patent Number: 6,026,263

[45] Date of Patent: Feb. 15, 2000

[54] COMBINATION INCLUDING CONTAINER FOR DEVELOPER AND ROTATING SHAFT MOUNTED IN CONTAINER WITH IMPROVEMENTS PREVENTING TONER FROM PENETRATING A GAP FORMED BY THE SHAFT AND ENSURING THAT AN AGITATOR/CONVEYOR OF THE SHAFT ACTS TO FULLY AGITATE THE TONER

[75] Inventors: Akinobu Nakahata; Shinya Kawakami; Takeshi Aoki, all of Osaka; Hiroshi Inui, Kakogawa, all of Japan

[73] Assignee: Mita Industrial Co., Ltd., Osaka, Japan

[21] Appl. No.: 09/212,475

[22] Filed: Dec. 16, 1998

[51] Int. Cl.[7] ..... G03G 15/08; G03G 15/04; G03G 21/10

[52] U.S. Cl. ..... 399/263; 399/102

[58] Field of Search ..... 399/98, 102, 106, 399/256, 263, 260, 261

[56] References Cited

U.S. PATENT DOCUMENTS

| | | | |
|---|---|---|---|
| 5,729,803 | 3/1998 | Nakaue et al. | 399/261 |
| 5,923,931 | 7/1999 | Kishimoto | 399/102 |

FOREIGN PATENT DOCUMENTS

| | | |
|---|---|---|
| 1-186982 | 7/1989 | Japan . |
| 7-199621 | 8/1995 | Japan . |
| 8-185105 | 7/1996 | Japan . |

*Primary Examiner*—Arthur T. Grimley
*Assistant Examiner*—Quana Grainger
*Attorney, Agent, or Firm*—Smith, Gambell & Russell, LLP

[57] ABSTRACT

A developing device having a container including a pair of side walls disposed with spacing, an entry port and a delivery port defined between the side walls, and a main wall extending between the entry port and the delivery port. A rotating shaft is rotatably mounted between the pair of side walls of the container, and agitator/conveyor means is mounted on the rotating shaft. A blind hole circular in cross section is formed at an inner surface of one of the side walls, and one end portion of the rotating shaft is rotatably inserted into the blind hole. At least one discharge groove is formed at an outer peripheral surface of the one end portion of the rotating shaft. The agitator/conveyor means is composed of a flexible agitating/conveying member extending from the rotating shaft in a radial direction of the rotating shaft. When the rotating shaft is rotationally driven, the agitating/conveying member moves a developer from a site near the entry port toward the delivery port while rubbing an inner surface of the main wall of the container.

14 Claims, 8 Drawing Sheets

COMBINATION INCLUDING CONTAINER FOR DEVELOPER AND ROTATING SHAFT MOUNTED IN CONTAINER WITH IMPROVEMENTS PREVENTING TONER FROM PENETRATING A GAP FORMED BY THE SHAFT AND ENSURING THAT AN AGITATOR/CONVEYOR OF THE SHAFT ACTS TO FULLY AGITATE THE TONER

FIELD OF THE INVENTION

This invention relates to a combination including a container for accommodating a developer containing at least a toner, and a rotating shaft rotatably mounted in the container, the combination being used for an electrostatic image forming machine, such as an electrostatic copier or an electrostatic printer.

DESCRIPTION OF THE PRIOR ART

In an electrostatic image forming machine, as is well known, an electrostatic latent image is formed on an electrophotographic photoconductor, and then a toner is applied to the electrostatic latent image to develop it into a toner image. In a typical example of a developing device for developing the electrostatic latent image into a toner image, a developer moving container is disposed which includes a pair of side walls, an entry port defined between the pair of side walls, a delivery port similarly defined between the pair of side walls, and a main wall extending between the entry port and the delivery port. The entry port is usually placed at an upper surface of the moving container. Above the entry port, a toner cartridge accommodating a toner is mounted removably. At a lower surface of the toner cartridge, a discharge port is formed which is situated in correspondence with the entry port of the container. The toner in the toner cartridge is introduced into the moving container through the discharge port and the entry port. The delivery port is formed, for example, at a front surface of the moving container, and is caused to communicate with a development container which is advantageously formed integrally with the moving container. Between the pair of side walls of the moving container, a rotating shaft is rotatably mounted. On this rotating shaft, agitator/conveyor means composed, say, of a plurality of plate-like pieces is disposed. The rotating shaft is drivingly connected to a drive source which may be an electric motor. When the rotating shaft is rotationally driven in a predetermined direction, toner introduced through the entry port is transported toward the delivery port by the action of the agitator/conveyor means, and fed into the development container through the delivery port. In the development container, developer applicator means for applying toner to an electrostatic latent image is disposed.

At an inner surface of one of the pair of side walls of the moving container, a blind hole circular in cross section is formed. One end portion of the rotating shaft is rotatably inserted into the blind hole. According to this manner of support for the one end portion of the rotating shaft, leakage of toner is reliably prevented without the need to use relatively expensive sealing means. The other end portion of the rotating shaft needs to be drivingly connected to the drive source. Thus, the other end portion of the rotating shaft usually protrudes outward through a through-hole formed in the other of the pair of side walls. To prevent toner from leaking through the through-hole, it is necessary to dispose suitable sealing means on the through-hole.

With the above-described conventional developing device, the following problems to be solved exist:

First, toner tends to penetrate the gap between the inner peripheral surface of the blind hole and the outer peripheral surface of the one end portion of the rotating shaft inserted into the blind hole, and dwell there. Because of this dwelling of toner, torque necessary for rotating the rotating shaft may become excessive.

Secondly, the agitator/conveyor means disposed on the rotating shaft does not effectively act on the toner present near the inner surface of the main wall of the moving container. Thus, a considerable amount of toner tends to adhere to the inner surface of the main wall. The adhering toner is not conveyed toward the delivery port, but is wasted. Near the entry port, too, agitation of toner is insufficient, causing a tendency toward the lumpy solidification of toner.

A first object of the present invention is to make an improvement such that even when toner penetrates the gap between the inner peripheral surface of the blind hole and the outer peripheral surface of the one end portion of the rotating shaft inserted into the blind hole, such toner does not dwell there, but is returned into the container in a fully satisfactory manner.

A second object of the invention is to make an improvement such that the agitator/conveyor means disposed on the rotating shaft acts fully effectively on the toner present near the inner surface of the main wall, thus fully preventing toner from adhering to the inner surface of the main wall.

Another additional object of the invention is to make an improvement such that even near the entry port, toner is effectively agitated, whereby the solidification of toner is fully avoided.

SUMMARY OF THE INVENTION

To attain the above first object, the present invention forms a discharge groove of a unique shape in the one end portion of the rotating shaft inserted into the blind hole. Toner, which has penetrated the gap between the inner peripheral surface of the blind hole and the outer peripheral surface of the one end portion of the rotating shaft inserted into the blind hole, is returned automatically into the container by the action of the discharge groove during the rotation of the rotating shaft.

More specifically, according to the present invention, the first object is attained by a combination comprising:

- a container for accommodating a developer containing at least a toner, the container having a pair of side walls disposed with spacing;
- a rotating shaft rotatably mounted between the pair of side walls of the container; and
- a drive source for rotating the rotating shaft in a predetermined direction, wherein
- a blind hole circular in cross section is formed at an inner surface of one of the side walls,
- one end portion of the rotating shaft is rotatably inserted into the blind hole, and
- at least one discharge groove extending beyond an open end of the blind hole longitudinally inwardly of the rotating shaft from one end of the rotating shaft is formed at an outer peripheral surface of the one end portion of the rotating shaft, at least part of the discharge groove being inclined longitudinally inwardly of the rotating shaft to an upstream side, as viewed in a rotating direction of the rotating shaft.

Such a combination can be applied not only to a moving container in a developing device, but also to a development container in the developing device, a container constituting a toner feed hopper, and a toner accommodating container in a toner cartridge.

Preferably, the discharge groove is composed of an uninclined portion extending parallel to a central axis of the rotating shaft from the one end, and an inclined portion continued from the uninclined portion and extending longitudinally inwardly of the rotating shaft in a manner inclined to the upstream side, as viewed in the rotating direction of the rotating shaft, up to a position beyond the open end of the blind hole. A plurality of the discharge grooves may be formed with spacing in a circumferential direction. In a preferred embodiment, the blind hole has an inner peripheral surface of a cylindrical shape, while the one end portion of the rotating shaft has an outer peripheral surface of a cylindrical shape. In the other side wall, a through-hole is formed. The other end portion of the rotating shaft is present extendedly through the through-hole. To a protrusion, from the other side wall, of the other end portion of the rotating shaft, the drive source is drivingly connected.

To attain the aforementioned second object, according to the present invention, the agitator/conveyor means mounted on the rotating shaft is composed of a flexible agitating/conveying member capable of rubbing the inner surface of the main wall.

That is, according to the present invention, the second object is attained by a combination comprising:

a container for accommodating a developer containing at least a toner, the container including a pair of side walls disposed with spacing, an entry port defined between the side walls, a delivery port defined between the side walls, and a main wall extending between the entry port and the delivery port;

a rotating shaft rotatably mounted between the pair of side walls;

a drive source for rotating the rotating shaft in a predetermined direction; and agitator/conveyor means mounted on the rotating shaft, wherein the agitator/conveyor means is composed of a flexible agitating/conveying member extending from the rotating shaft in a radial direction of the rotating shaft, an extending length of the agitating/conveying member is greater than spacing between the rotating shaft and an inner surface of the main wall of the container, and when the rotating shaft is rotationally driven in the predetermined direction, the agitating/conveying member moves the developer from a site near the entry port toward the delivery port while rubbing the inner surface of the main wall.

The agitating/conveying member can be formed from a plastic film. Preferably, a front half, in an extending direction, of the agitating/conveying member has a plurality of openings or notches. In a rear half, in the extending direction, of the agitating/conveying member, it is preferred that a plurality of channel-like slits are formed with spacing in a longitudinal direction of the rotating shaft, each slit comprising a pair of radial slit portions extending radially of the rotating shaft with predetermined spacing in a longitudinal direction of the rotating shaft, and a longitudinal slit portion extending longitudinally of the rotating shaft between the front ends of the pair of slit portions. In a preferred embodiment, a developer detecting portion formed from a transparent or translucent material is disposed on the main wall of the container. The developer detecting portion is composed of a pair of channel-like depressed portions depressed inwardly with spacing in the longitudinal direction of the rotating shaft. Developer detector means is disposed which includes a light-emitting element placed in one of the pair of depressed portions, and a light-receiving element placed in the other of the pair of depressed portions. At least the front half, in the extending direction, of the agitating/conveying member is notched at a site thereof corresponding to the developer detecting portion. Preferably, the agitator/conveyor means is composed of a pair of the agitating/conveying members arranged side by side in a direction of the central axis of the rotating shaft, and inner end portions of the pair of agitating/conveying members, as viewed in the longitudinal direction of the rotating shaft, are located in correspondence with the developer detecting portion. On the rotating shaft, a flexible cleaning member is mounted which is disposed upstream of the agitating/conveying members as viewed in the rotating direction of the rotating shaft, and which is moved between the pair of depressed portions of the developer detecting portion. The flexible cleaning member can be formed from a plastic film. Advantageously, the entry port of the container is disposed at an upper surface of the container, the delivery port of the container is disposed at a front surface of the container, a toner cartridge is removably mounted above the container, and toner accommodated in the toner cartridge is introduced into the container through the entry port. To attain the aforementioned additional object, a flexible oscillating member which extends rearward from a base edge extending along a front edge of the entry port is disposed. In the oscillating member, a plurality of toner introduction openings are formed. The oscillating member can be formed from a plastic film. Preferably, a weight is fixed to an extension edge of the oscillating member. When the agitating/conveying member does not act on the oscillating member, an extension end portion of the oscillating member droops. When the agitating/conveying member is caused to rotate while rubbing the oscillating member, the extension end portion of the oscillating member is moved upwards. At a lower surface of the toner cartridge, a discharge port corresponding to the entry port of the container is formed. In the discharge port, a plurality of ribs are preferably formed with spacing in the longitudinal direction of the rotating shaft. Also preferably, the weight fixed to the extension edge of the oscillating member is contacted with the ribs. Thus, the oscillating member is prevented from protruding upward beyond the entry port of the container.

DETAILED DESCRIPTION OF THE PREFERRED EMBODIMENTS

The present invention will now be described in detail by reference to the accompanying drawings illustrating preferred embodiments of a developing device constructed in accordance with the invention.

Figure 1:
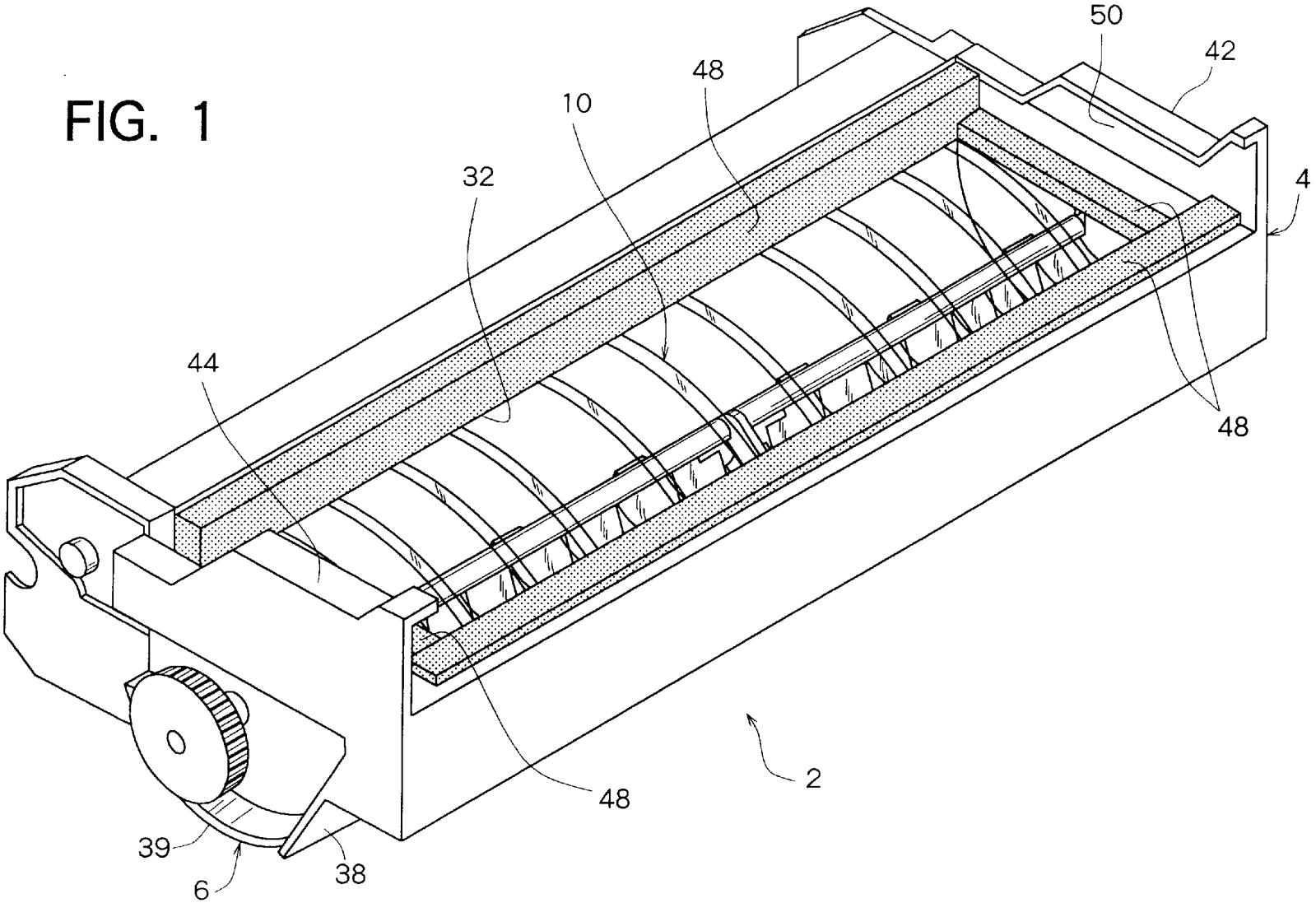
FIG. 1 is a perspective view showing a main part of a developing device constructed in accordance with the present invention.
Figure 2:
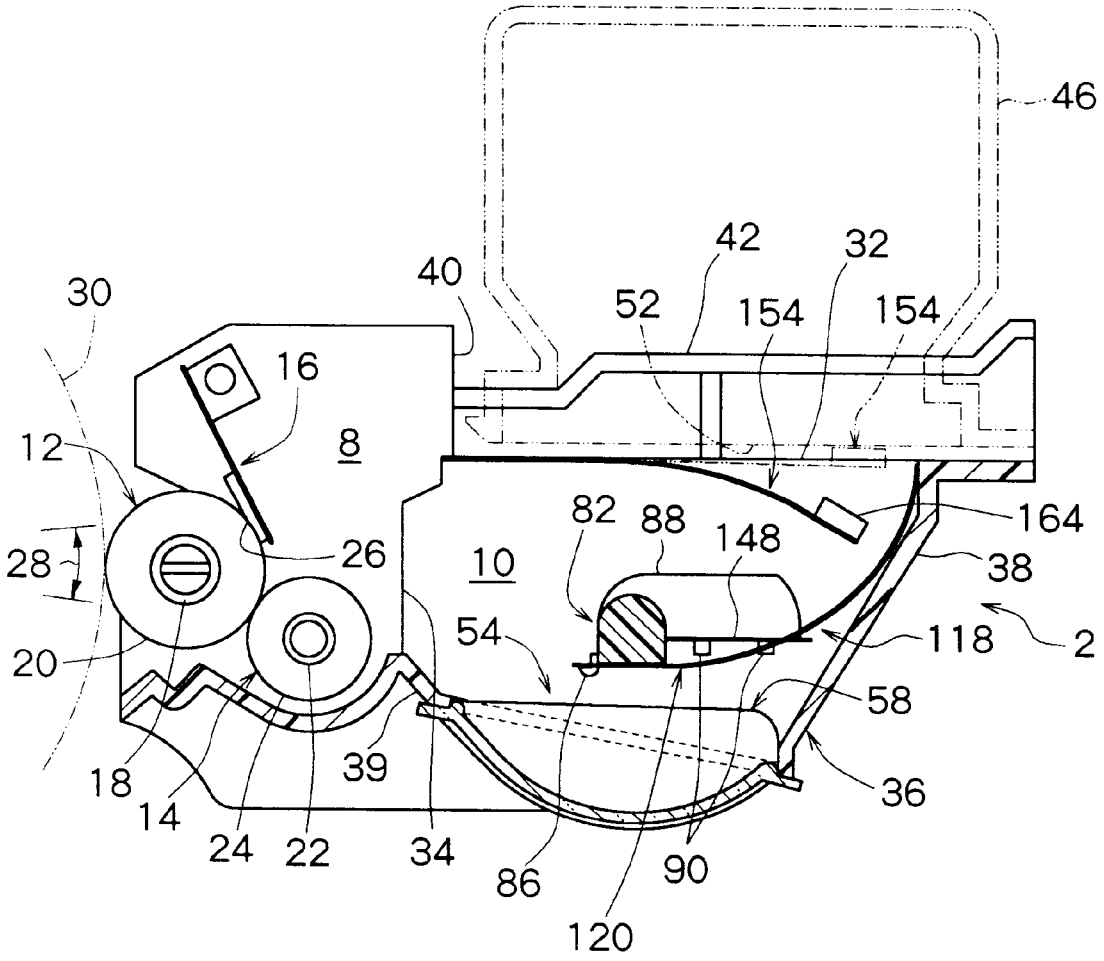
FIG. 2 is a sectional view of the developing device shown in FIG. 1.

With reference to FIGS. 1 and 2, the illustrated developing device has a development housing, entirely indicated at the numeral 2, which is advantageously molded integrally from a suitable synthetic resin such as ABS resin. This development housing 2 has a pair of side walls 4 and 6 disposed with spacing. Between the side walls 4 and 6, a development container 8 and a moving container 10 are defined.

Referring to FIG. 2, the development container 8 is defined in a left half of the development housing 2 in FIG. 2. A front surface (left end face in FIG. 2) of the development container 8 is open, while its rear surface (right end face in FIG. 2) communicates with the moving container 10. In the development container 8, developer applicator means 12 is disposed. In association with the developer applicator means 12, developer feed means 14 and developer restricting means 16 are disposed. The developer applicator means 12 is composed of a rotating shaft 18 mounted between the side walls 4 and 6, and an applicator roller 20 disposed on the rotating shaft 18. The applicator roller 20 can be formed from a flexible material such as synthetic rubber. The developer feed means 14 is composed of a rotating shaft 22 mounted between the side walls 4 and 6, and a feed roller 24 disposed on the rotating shaft 22. The feed roller 24 which can be formed from a flexible material such as synthetic rubber is brought into intimate contact with the applicator roller 20 of the developer applicator means 12. The developer restricting means 16 is formed from a rigid plate 26 such as a glass sheet. The rigid plate 26 has its front end portion pressed against the applicator roller 20 of the developer applicator means 12 by suitable urging means (not shown). A developer is moved from the moving container 10 into the development container 8 in a manner to be described later on (the developer itself is not shown, but a developer consisting of a toner alone is used in the illustrated embodiment). The developer moved into the development container 8 is fed onto the applicator roller 20 by the feed roller 24 that is rotated counterclockwise in FIG. 2. The applicator roller 20 is protruded outward through the open front surface. In a developing area 28, the applicator roller 20 is intimately contacted with a rotating drum 30 (only a part thereof is shown schematically in FIG. 2). On a circumferential surface of the rotating drum 30 rotated clockwise in FIG. 2, an electrophotographic photoconductor is disposed. On this electrophotographic photoconductor, an electrostatic latent image is formed by suitable means (not shown). The applicator roller 20 of the developer applicator means 12 is rotated counterclockwise in FIG. 2 to convey a developer held on its circumferential surface to the developing area 28. In the developing area 28, the applicator roller 20 applies the developer to the electrostatic latent image formed on the circumferential surface of the rotating drum 30, thereby developing this image into a toner image. The developer restricting means 16 restricts the amount of the developer held on the circumferential surface of the applicator roller 20 to a required value. The development container 8, and the developer applicator means 12, developer feed means 14 and developer restricting means 16 disposed in the development container 8 do not constitute a novel feature of the developing device constructed in accordance with the present invention; they may be of forms well known to people skilled in the art, and thus their detailed descriptions will be omitted herein.

Further with reference to FIGS. 1 and 2, the moving container 10 is defined in a right half of the development housing 2 in FIG. 2. At an upper surface of the moving container 10, a rectangular entry port 32 is formed. At a front surface (left end face in FIG. 2) of the moving container 10, a delivery port 34 is formed which makes the moving container 10 communicate with the development container 8. The entry port 32 is present in a substantially horizontally extended manner. As will be understood by reference to FIG. 2, a main wall 36 is disposed which extends from a rear edge (right edge in FIG. 2) of the entry port 32 to a lower edge of the delivery port 34. The main wall 36 has a rear wall portion 38 extending in a downwardly forwardly (leftwardly in FIG. 2) inclined manner, and a bottom wall portion 39 extending nearly arcuately in FIG. 2. An upright wall 40 is disposed which extends upward from a front edge (left edge in FIG. 2) of the entry port 32. The side walls 4 and 6 are provided with protrusions 42 and 44, respectively, which protrude upward beyond the entry port 32. These protrusions 42 and 44 of the side walls 4 and 6 define, in collaboration with the upright wall 40, a toner cartridge mounting region for accepting a lower part of a toner cartridge 46 (indicated by a two-dot chain line in FIG. 2). As clearly shown in FIG. 1, a sealing member 48 (the sealing member 48 is not shown in FIG. 2) is disposed for sealing the gap between the moving container 10 and the toner cartridge 46. The sealing member 48 can be formed from a flexible material such as sponge. As will be understood by reference to FIG. 1, a guide channel 50 is formed at an inner surface of each of the protrusions 42 and 44 of the side walls 4 and 6. At both side surfaces of the toner cartridge 46, guided pieces (not shown) are formed. Engagement of such guided pieces with the guide channels 50 results in the removable of the toner cartridge 46 in the toner cartridge mounting region of the moving container 10. At a lower surface of the toner cartridge 46, a toner discharge port 52 is formed. On the lower surface of the toner cartridge 46, a sealing member (not shown) is mounted so as to be peelable. After the toner cartridge 46 is mounted in the toner cartridge mounting region, such a sealing member is removed to open the toner discharge port 52. Thus, toner accommodated in the toner cartridge 46 is introduced into the moving container 10 through the toner discharge port 52 and the entry port 32. As will be further mentioned later on, the developer in the moving container 10 (in the illustrated embodiment, a developer consisting of toner alone) is moved into the development container 8 through the delivery port 34. The constitution of the toner cartridge 46 itself and the manner of mounting of the toner cartridge do not constitute novel features of the developing device constructed in accordance with the present invention. They may be of forms well known to people skilled in the art, and thus their detailed descriptions will be omitted herein.

Figure 3:
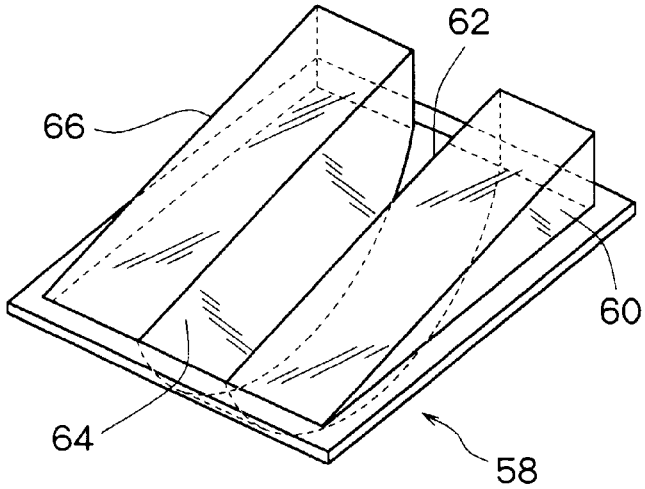
FIG. 3 is a partial perspective view showing a developer detecting portion of a moving container in the developing device shown in FIG. 1.
Figure 4:
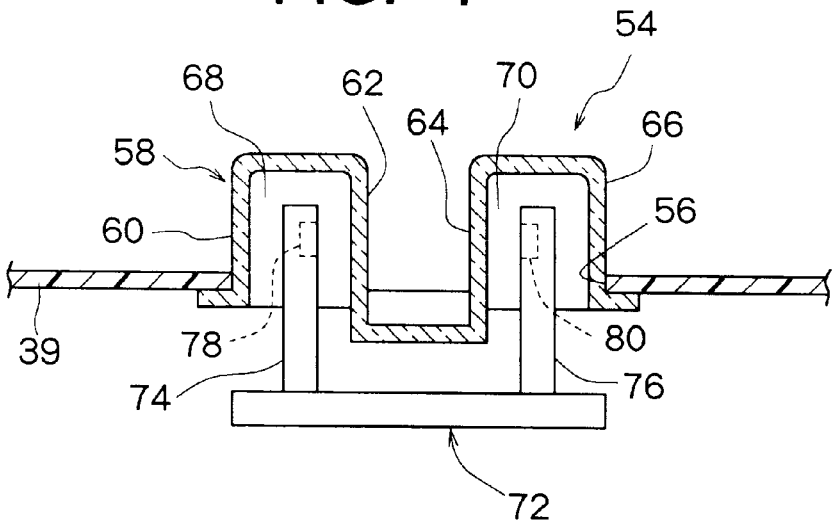
FIG. 4 is a sectional view of the developer detecting portion shown in FIG. 3.

Further with reference to FIGS. 3 and 4 along with FIG. 2, a developer detecting portion 54 is disposed in a central part, in a width direction (a direction perpendicular to the sheet face of FIG. 2, and a longitudinal direction of a rotating shaft to be described later on), of the bottom wall portion 39 of the main wall 36 of the moving container 10. In the illustrated embodiment, an opening 56 is formed in the bottom wall portion 39. To this opening 56, a member 58 defining the developer detecting portion 54 is fixed. The member 58 which may be formed from a suitable synthetic resin is transparent or translucent. As will be understood from FIGS. 3 and 4, the member 58 has four wall portions, 60, 62, 64 and 66, protruding into the moving container 10 parallel to each other with spacing in the width direction of the moving container 10. In this configuration, the member 58 defines a pair of depressed portions depressed in the moving container 10 with spacing in the width direction of the moving container 10, i.e., a depressed portion 68 defined between the wall portions 60 and 62, and a depressed portion 70 defined between the wall portions 64 and 66. As shown in FIG. 4, developer detector means 72 is disposed outside the developer detecting portion 54. The developer detector means 72 has a support arm 74 extending into the depressed portion 68, and a support arm 76 extending into the depressed portion 70. A light-emitting element 78 is placed on the support arm 74, while a light-receiving element 80 is placed on the support arm 76. As will be further mentioned later on, when a sufficient amount of developer exists between the depressed portion 68 and the depressed portion 70 in the moving container 10, light from the light-emitting element 78 is intercepted by the developer. Thus, the light-receiving element 80 does not receive light. When a sufficient amount of developer does not exist between the depressed portions 68 and 70 in the moving container 10, on the other hand, light from the light-emitting element 78 reaches the light-receiving element 80.

Figure 5:
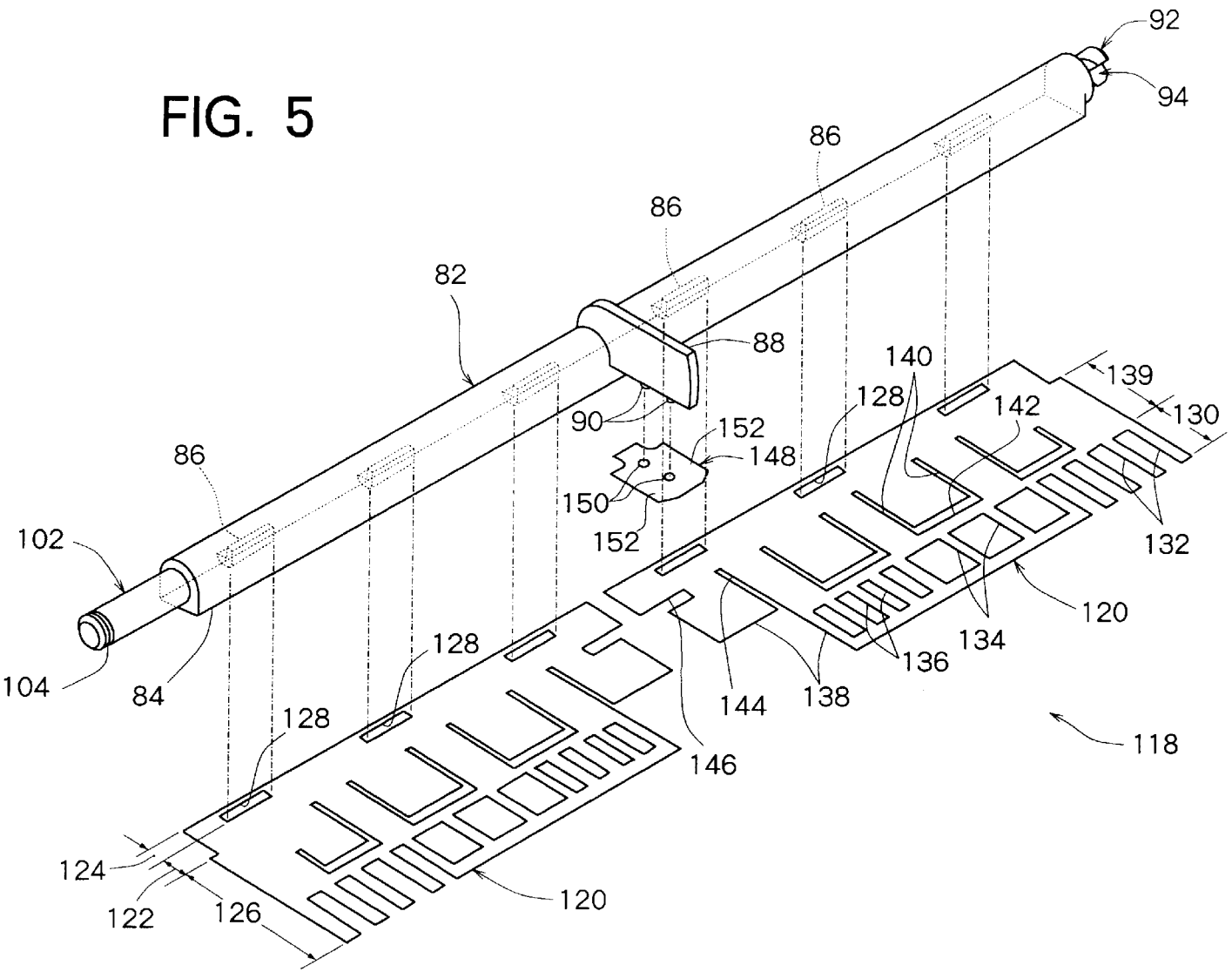
FIG. 5 is an exploded perspective view showing a rotating shaft, agitator/conveyor means, and cleaning means disposed in the moving container of the developing device shown in FIG. 1.
Figure 6:
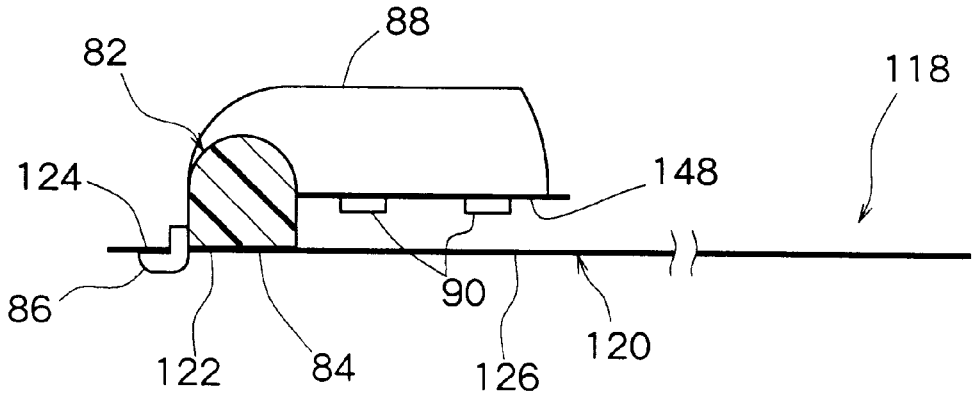
FIG. 6 is a sectional view of the rotating shaft shown in FIG. 5.

With reference to FIGS. 5 and 6 along with FIG. 2, a rotating shaft 82 extending substantially horizontally is rotatably mounted in the moving container 10. The rotating shaft 82 may be formed from synthetic resin which may be ABS resin incorporating, say, glass fibers for reinforcement. A main portion (a portion except both end portions to be described later on) of the rotating shaft 82 has a cross-sectional shape, which, as clearly shown in FIG. 6, comprises a rectangular shape added to a semicircular shape. In this main portion, a flat support surface 84 is formed. As will be understood by referring to FIG. 5, a plurality of (six in the illustrated embodiment) engaging stop protrusions 86 are formed with spacing in the longitudinal direction of the main portion of the rotating shaft 82. Each of the engaging stop protrusions 86 is extended nearly parallel to the support surface 84 from one edge of the support surface 84. At a central part in the longitudinal direction of the rotating shaft 82, a support arm 88 extending from a semicylindrical outer surface is formed. On one surface (lower surface in FIG. 6) of the support arm 88, two protrusions 90 are formed.

Figure 7:
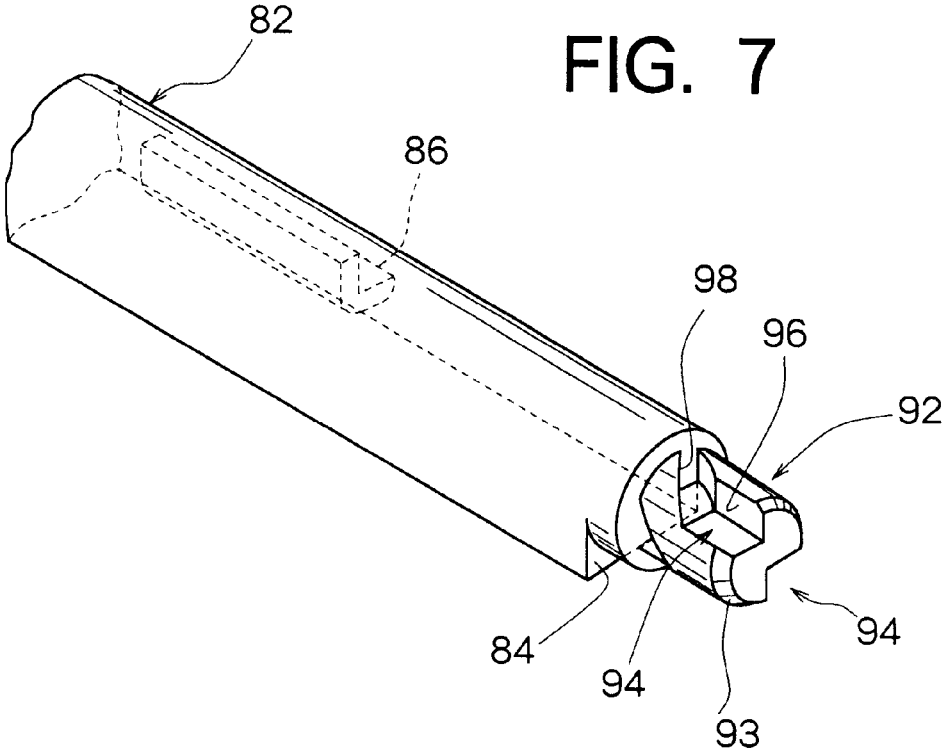
FIG. 7 is a partial perspective view showing one end portion of the rotating shaft shown in FIG. 5.

Further with reference to FIG. 7 along with FIG. 5, one end portion 92 of the rotating shaft 82 is formed in a relatively small diameter cylindrical shape. A front end of the one end portion 92 is chambered to form a truncated conical portion 93. At an outer peripheral surface of the one end portion 92, it is important that at least one discharge groove 94 be formed. In the illustrated embodiment, two of the discharge grooves 94 are formed at an angular distance of 180 degrees. Each of the discharge grooves 94 is composed of an uninclined portion 96 extending parallel to a central axis of the rotating shaft 82 from one end, and an inclined portion 98 continued from the uninclined portion 96 and extending longitudinally inwardly of the rotating shaft 82 in a manner inclined to an upstream side, as viewed in a rotating direction of the rotating shaft 82 (clockwise in FIG. 2). It is important that each discharge groove 94 be an inclined portion at least partly; in other words, at least part of it extend longitudinally inwardly of the rotating shaft 82 in a manner inclined to the upstream side, as viewed in the rotating direction of the rotating shaft 82. If desired, the entire discharge groove 94 can be configured to extend longitudinally inwardly of the rotating shaft 82 in a manner inclined to the upstream side, as viewed in the rotating direction of the rotating shaft 82. By so doing, however, the discharge groove 94, at one end thereof, is acute-angled with respect to one end face, forming an acute angle portion susceptible to damage. The angle of inclination, to the central axis of the rotating shaft 82, of the inclined portion 98 in each discharge groove 94 may be about 30 to 60 degrees.

Figure 8:
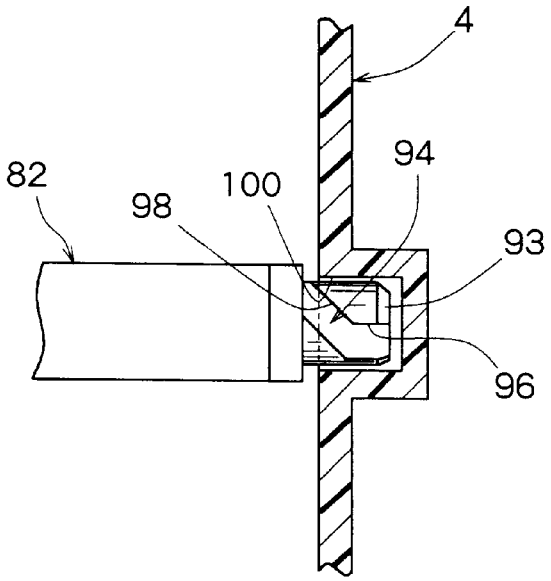
FIG. 8 is a partial sectional view showing how the one end portion of the rotating shaft shown in FIG. 5 is supported.

With reference to FIG. 8, a blind hole 100 having a cylindrical inner peripheral surface is formed in the side wall 4, one of the side walls 4 and 6. The internal diameter of the blind hole 100 is substantially equal to, or slightly larger than, the external diameter of the one end portion 92 of the rotating shaft 82. For example, the design dimension of the external diameter of the one end portion 92 of the rotating shaft 82 can be set at x+(0.01 to 0.05) mm, while the design dimension of the internal diameter of the blind hole 100 can be set at x−(0.01 to 0.05) mm. As shown in FIG. 8, the one end portion 92 of the rotating shaft 82 is inserted into the blind hole 100, and can be rotatably supported thereby. According to a configuration (to be described later on) of the other end portion of the rotating shaft 82, the relative positions, in the longitudinal direction of the rotating shaft 82, of the one end portion 92 of the rotating shaft 82 and the blind hole 100 are defined in a state shown in FIG. 7. As is understood from FIG. 7, it is important that each of the discharge grooves 94 extend longitudinally inwardly of the rotating shaft beyond an open end of the blind hole 100; in other words, an inner end of each of the discharge grooves 94 (in the illustrated embodiment, an inner end of the one end portion 92, because the discharge groove 94 extends up to the inner end of the one end portion 92 of the rotating shaft 82) is located not in the blind hole 100, but inwardly thereof.

Toner accommodated in the moving container 10 comprises very small particles, which penetrate the gap between the outer peripheral surface of the one end portion 92 of the rotating shaft 82 and the inner peripheral surface of the blind hole 100. The toner that has penetrated the gap between the outer peripheral surface of the one end portion 92 of the rotating shaft 82 and the inner peripheral surface of the blind hole 100 is forced into the discharge groove 94 by a scraper action of one side edge of the discharge groove 94 during the rotation of the rotating shaft 82. Then, owing to the presence of the inclined portion 98 in the discharge groove 94, the toner is moved within the discharge groove 94 longitudinally inwardly of the rotating shaft 82, whereby the toner is returned from the blind hole 100 into the moving container 10. This reliably avoids problems such that toner heaps between the outer peripheral surface of the one end portion 92 of the rotating shaft 82 and the inner peripheral surface of the blind hole 100, thereby impeding the rotation of the rotating shaft 82.

Figure 9:
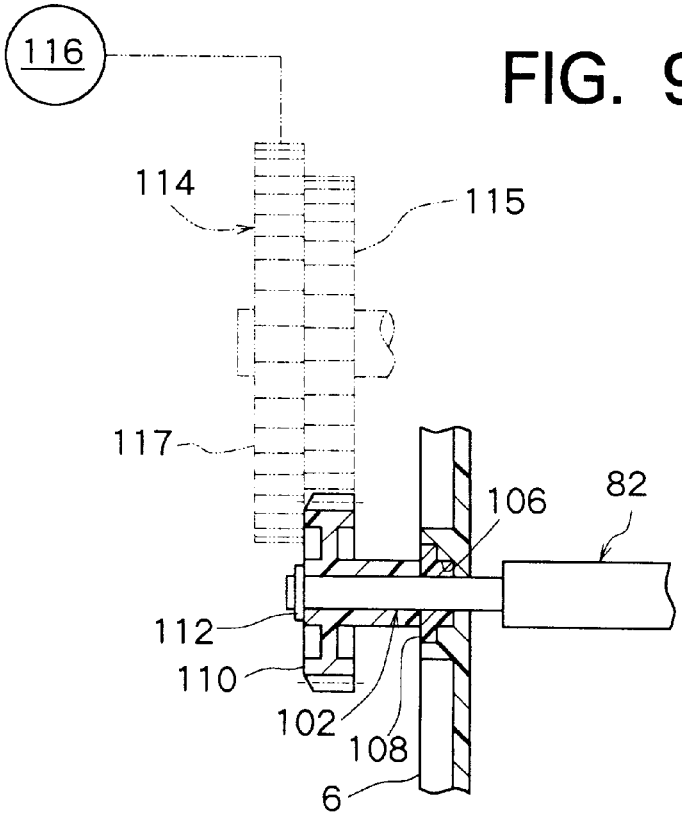
FIG. 9 is a partial sectional view showing how the other end portion of the rotating shaft shown in FIG. 5 is supported.

Further referring to FIG. 9 together with FIG. 5, a pin member 102 extending coaxially with and continued from the main portion of the rotating shaft 82 is fixed to the other end portion of the rotating shaft 82. The pin member 102, advantageously formed from carbon steel, can be fixed to the main portion of the rotating shaft 82 by insert molding (i.e., by inserting the pin member 102 into a mold when forming the main portion of the rotating shaft 82). In a front end portion of the pin member 102, an annular groove 104 is formed. In the other of the side walls 4 and 6, i.e., in the side wall 6, a through-hole 106 is formed, and a bearing member 108 is fixed in the through-hole 106. It is important for the bearing member 108 to have a bearing mechanism for rotatable support of the pin member 102, and also have a sealing function for preventing the leakage of toner from inside the moving container 10 through the through-hole 106. For these purposes, the bearing member 108 can be formed from, say, polyamide resin. As will be clearly shown in FIG. 9, the pin member 102 fixed to the other end portion of the rotating shaft 82 is inserted through the bearing member 108, and projected outward. On a projecting end portion of the pin member 102, an input gear 110 is mounted. In the projecting end portion of the pin member 102, a so-called D-cut (not shown) is made. On the other hand, the cross-sectional shape of a through-hole formed in the input gear 110 is a corresponding D-shape, so that the input gear 110 is mounted so as to turn integrally with the pin member 102. A snap ring 112 is fixed on the annular groove 104 of the pin member 102. Further, a hub of the input gear 110 is interposed between an outer end face of the bearing member 108 and the snap ring 112. Thus, the relative movement of the rotating shaft 82 and the input gear 110 in the longitudinal direction of the rotating shaft 82 is inhibited. As schematically shown in FIG. 9, in association with the input gear 110, an integrally molded dual gear 114 is rotatably mounted at a predetermined position. The input gear 110 is engaged with a first gear 115 of the dual gear 114, and is drivingly connected to a rotational drive source 116, which may be an electric motor, through the dual gear 114 and a suitable transmission mechanism (not shown). The outer end face of the input gear 110 is contacted with an inner end face of a second gear 117 of the dual gear 114. Thus, the input gear 110 is interposed between the inner end face of the second gear 117 and the outer end face of the bearing member 108, whereby the position in an axial direction (right-to-left direction) of the input gear 110 is restricted. Consequently, the longitudinal position, relative to the side walls 4 and 6, of the rotating shaft 82 having the input gear fixed thereto is restricted.

Referring to FIG. 5 again, agitator/conveyor means 118 is mounted on the rotating shaft 82. In the illustrated embodiment, the agitator/conveyor means 118 is composed of a pair of agitating/conveying members 120 placed side by side in a longitudinal direction of the rotating shaft 82 (a width direction of the moving container 10). The pair of agitating/conveying members 120 are placed side by side with a slight spacing in the longitudinal direction of the rotating shaft 82, and are symmetric to each other with respect to a plane extending perpendicularly to the central axis of the rotating shaft 82. Importantly, each of the pair of agitating/conveying members 120 is formed from a flexible material, which may be, for example, a plastic film such as a polyethylene terephthalate film. Each agitating/conveying member 120 is generally rectangular, and has a bonding portion 122 to be bonded to the support surface 84 of the rotating shaft 82, an engaging stop portion 124 projecting rearward from the bonding portion 122, and a main portion 126 extending forward from the bonding portion 122. In the engaging stop portion 124, three engaging stop slits 128 are formed with spacing in the longitudinal direction of the rotating shaft 82. In a first half (i.e., a front half) 130 of the main portion 126 extending from the bonding portion 122 in a radial direction of the rotating shaft 82, there are formed a plurality of rectangular notches 132, a plurality of rectangular openings 134 with a relatively large area, and a plurality of rectangular openings 136 with a relatively small area. An inner end portion of the first half 130 of the main portion 126 is notched in a relatively large rectangular form as shown by the numeral 138. In other words, no first half exists in the inner end portion of the main portion 126. The inner end portion of the main portion 126, which lies at a center as viewed in the direction of the central axis of the rotating shaft 82, is situated in correspondence with the aforementioned developer detecting portion 54 disposed in the moving container 10, as will be understood clearly from descriptions to be given later. In a latter half (i.e., a base half) 139 in an extending direction of the main portion 126, a plurality of channel-like slits are formed with spacing in the longitudinal direction of the rotating shaft 82, each channel-like slit comprising a pair of radial slits 140 extending radially of the rotating shaft 82 with spacing in the longitudinal direction of the rotating shaft 82, and a longitudinal slit 142 connecting together the front ends of these radial slits 140. In the inner end portion of the main portion 126, moreover, there are formed a radial slit 144 extending in the radial direction of the rotating shaft 82, and a relatively wide longitudinal slit 146 extending longitudinally outwardly from an inner end in a base end portion. The above-described various notches and openings formed in the agitating/conveying member 120 permit the agitating/conveying member 120 to flex entirely, or locally, in a required manner. In addition, when the agitating/conveying member 120 is rotated together with the rotating shaft 82, these notches and openings permit toner accommodated in the moving container 10 to escape through the notches and openings.

Further with reference to FIG. 2 along with FIG. 5, each of the agitating/conveying members 120 is mounted to the rotating shaft 82 by bonding the bonding portion 122 to the support surface 84 of the rotating shaft 82 by suitable bonding means such as a double-coated adhesive tape, and inserting the engaging stop protrusions 86 of the rotating shaft 82 through the engaging stop slits 128 formed in the engaging stop portion 124. An extending length of each agitating/conveying member 120 (excluding the inner end portion notched in a relatively large rectangular shape as shown by the numeral 138), which extends from the rotating shaft 82 in its radial direction, is made considerably larger than the spacing between the rotating shaft 82 and the inner surface of the main wall 36 of the moving container 10. Thus, when the agitating/conveying members 120 are rotated clockwise in FIG. 2 in accordance with the rotation of the rotating shaft 82, each of the agitating/conveying members 120 is appropriately curved as shown by a solid line in FIG. 2, and moved while rubbing the inner surface of the main wall 36.

With reference to FIG. 2 along with FIG. 5, cleaning means 148 is mounted on the support arm 88 formed at the central part in the longitudinal direction of the rotating shaft 82. This cleaning means 148 is formed from a flexible material which is preferably a plastic film such as a polyethylene terephthalate film. The cleaning means 148 is a plate-like piece with two holes 150. The cleaning means 148 is fixed to the support arm 88 by inserting the two protrusions 90 formed on one surface of the support arm 88 through the holes 150 of the cleaning means 148, then heating the protrusions 90 with suitable means such as ultrasonic irradiation, and pressing them. The cleaning means 148 has a pair of cleaning portions 152 extending bilaterally from the support arm 88. As will be further mentioned later on, when the cleaning means 148 is rotated in accordance with the rotation of the rotating shaft 82, the pair of cleaning portions 152 rub the inner surfaces of the wall portions 62 and 64 (FIG. 4) when passing through the developer detecting portion 54 to clean them. As will be understood by reference to FIG. 2, the cleaning means 148 is placed upward of the agitating/conveying member 120, as viewed in the rotating direction of the rotating shaft 81 (clockwise in FIG. 2).

Figure 10:
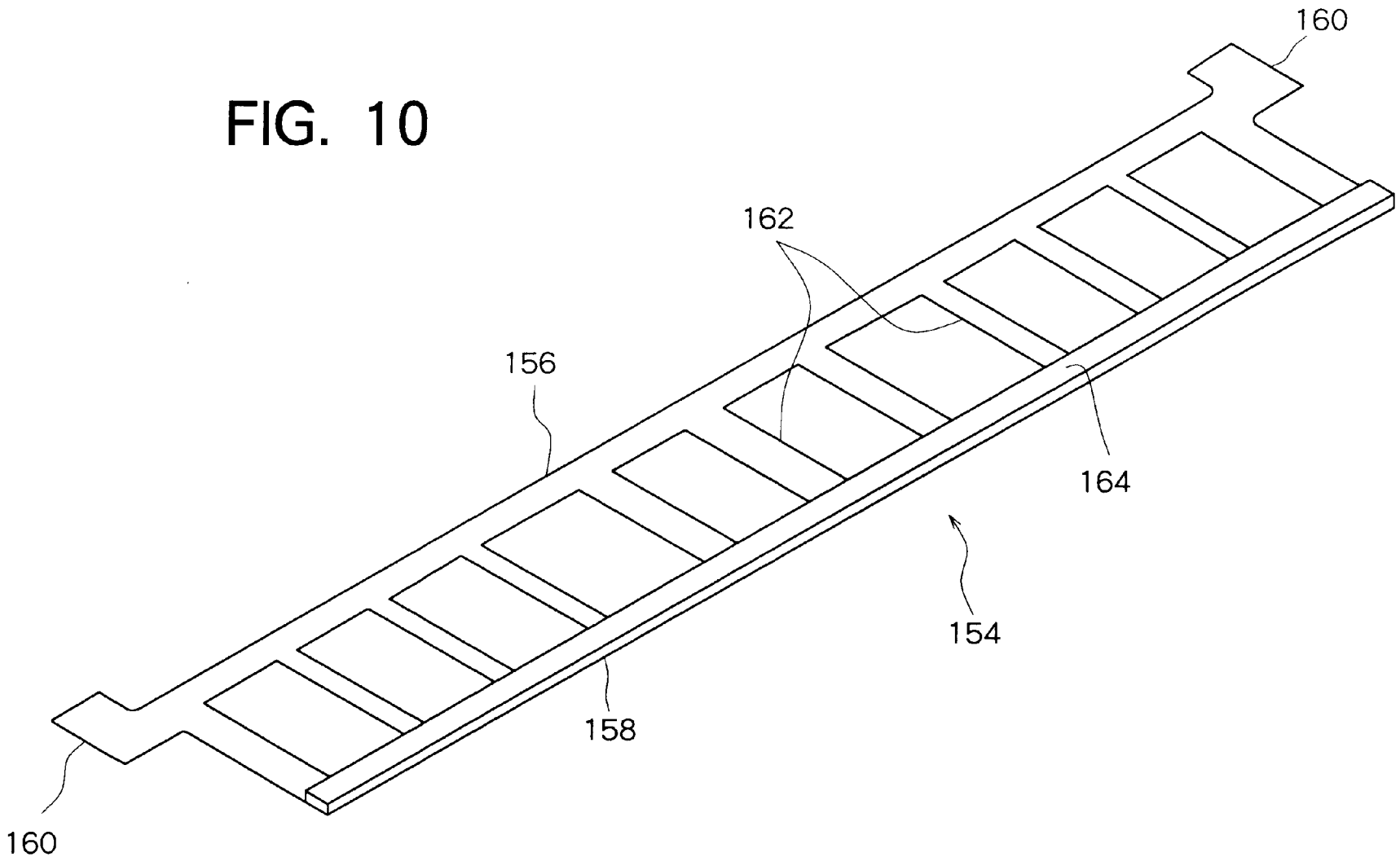
FIG. 10 is a perspective view showing an oscillating member disposed in the moving container of the developing device shown in FIG. 1.

Further referring to FIG. 10 along with FIGS. 1 and 2, an oscillating member 154 is disposed on the entry port 32 defined at the upper surface of the moving container 10. Importantly, this oscillating member 154 is formed from a flexible member, and can be advantageously formed from a suitable plastic film such as a polyethylene terephthalate film. As will be clearly shown in FIG. 10, the oscillating member 154 is nearly rectangular as a whole, and has a base edge 156 and an extension edge 158, each extending in the longitudinal direction of the rotating shaft 82. On both sides of the base edge 156, bonding pieces 160 extending in a width direction (the longitudinal direction of the rotating shaft 82) are formed. In a main portion of the oscillating member 154, a plurality of toner introduction openings 162 are formed with spacing in the width direction. Each of the toner introduction openings 162 may be rectangular in shape. To the extension edge 158 of the oscillating member 154, a weight 164 is fixed by suitable bonding means such as a double coated adhesive tape. The weight 164 may be in a slender form extending along the extension edge 158 of the oscillating member 154, and can be formed from synthetic resin such as ABS resin.

Figure 11:
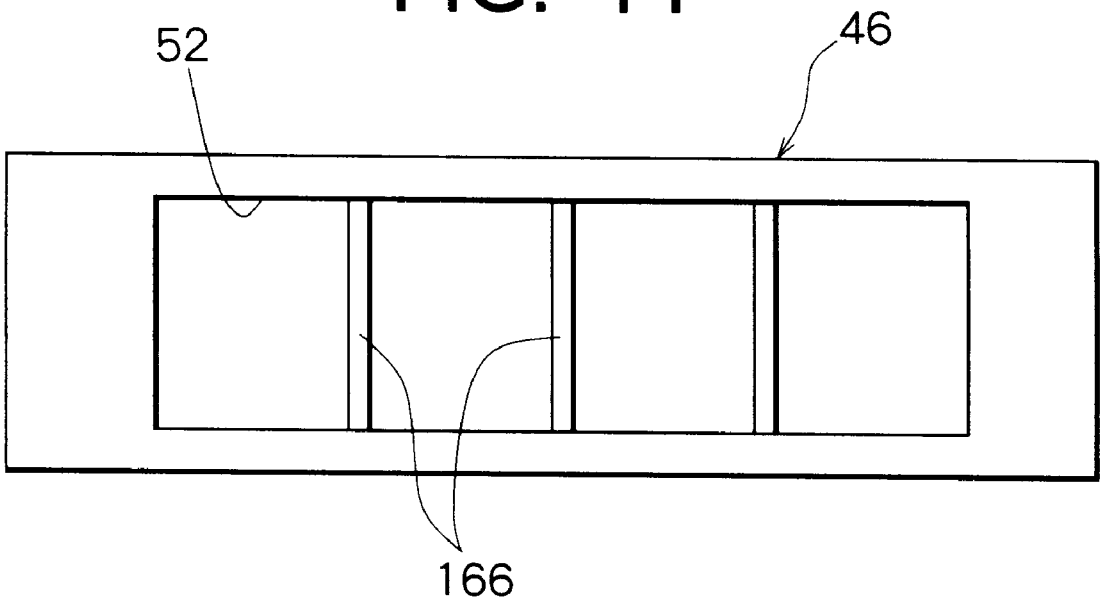
FIG. 11 is a bottom view showing a toner discharge port of a toner cartridge in the developing device shown in FIG. 1.

As will be understood by reference to FIGS. 1 and 2, the oscillating member 154 is disposed on the entry port 32 by bonding the bonding pieces 160, which are formed on both sides of the base edge 156, to both side portions of the front edge of the entry port 32 by suitable bonding means such as a double coated adhesive tape. The aforementioned sealing member 48 (FIG. 1) is located above the bonding pieces 160. The base edge 156 of the oscillating member 154 extends along the front edge of the entry port 32, the main portion of the oscillating member 154 extends rearward (rightward in FIG. 2) from the base edge 156, and the extension edge of the oscillating member 154 is situated near the rear edge of the entry port 32. When the agitating/conveying members 120 do not act on the oscillating member 154, an extension end portion of the oscillating member 154 droops because of the presence of the weight 164, as shown by a solid line in FIG. 2. When the agitating/conveying members 120, rotated in accordance with the rotation of the rotating shaft 82, gradually act on the oscillating member 154 from its base edge 156 toward its extension edge 158, the extension end portion of the oscillating member 154 is gradually moved upward, as shown by a two-dot chain line in FIG. 2. When the agitating/conveying members 120 leave the oscillating member 154 again, the oscillating member 154 rapidly returns to a state indicated by the solid line, i.e., a state in which the extension end portion droops. As illustrated in FIG. 11, a plurality of ribs 166 are disposed with spacing in a width direction (the longitudinal direction of the rotating shaft 82) in the toner discharge port 52 defined at the lower surface of the toner cartridge 46 mounted above the moving container 10. When the extension end portion of the oscillating member 154 is raised, the weight 164 is contacted with the ribs 166, whereby the extension end portion of the oscillating member 154 is prevented from projecting upward into the toner cartridge 46 beyond the toner discharge port 52.

Referring mainly to FIG. 2, in the above-described developing device, toner (not shown) accommodated in the toner cartridge 46, as stated earlier, is discharged downward through the toner discharge port 52 of the toner cartridge 46. Such toner is introduced into the moving container 10 through the toner introduction openings 162 of the oscillating member 154 disposed on the entry port 32 of the moving container 10. In the moving container 10, the rotating shaft 82 is rotated clockwise in FIG. 2. In accordance with this movement, the agitator/conveyor means 118 and the cleaning means 148 are also rotated clockwise in FIG. 2. The pair of agitating/conveying members 120 constituting the agitator/conveyor means 118 are suitably curved, and moved with their extension end portions rubbing the inner surface of the main wall 36 of the moving container 10. These agitating/conveying members 120 move the toner toward the delivery port 34 while agitating it, and feed it from the moving container 10 to the development container 8. Then, the agitating/conveying members 120 transport a surplus toner and toner, which has been returned from the development container 8 into the moving container 10 through an upper part of the delivery port 34, to the upper surface of the moving container 10. Then, the agitating/conveying members 120 convey the toner again along the main wall 36 while agitating it. During movement of the toner by the agitating/conveying members 120, the toner partly escapes through the openings and notches formed in the agitating/conveying members 120, thus promoting agitation of toner. Since the extension end portions of the agitating/conveying members 120 rub the inner surface of the main wall 36, toner is not piled on the inner surface of the main wall 36. The cleaning portions 152 of the cleaning means 148 periodically rub the inner surfaces of the wall portions 62 and 64 of the developer detecting portion 54 to clean them. This reliably prevents the occurrence of the problem that although there is no sufficient toner in the moving container 10, toner adheres to and piles up on the inner surfaces of the wall portions 62 and 64, thereby intercepting light from the light-emitting element 78 of the developer detector means 72.

The oscillating member 154 disposed on the entry port 32 of the moving container 10 is suitably oscillated between a state indicated by the solid line in FIG. 2 (a state in which the extension end portion droops) and a state indicated by the two-dot chain line in FIG. 2 (a state in which the extension end portion is raised) in accordance with the rotation of the agitating/conveying members 120. Thus, toner is effectively prevented from dwelling near the entry port 32 and becoming solid there. Also, introduction of toner from the toner cartridge 46 into the moving container 10 is promoted.

While the preferred embodiments of the present invention have been described in detail with reference to the accompanying drawings, it should be understood that the invention is not restricted to these embodiments, but various changes and modifications may be made without departing from the spirit and scope of the invention. For instance, a so-called single-component developer consisting only of a toner is used in the aforementioned developing device. However, the present invention can be applied to a developing device which uses a so-called two-component developer comprising a toner and carrier particles.

What we claim is:

1. A combination comprising:

a container for accommodating a developer containing at least a toner, said container having a pair of side walls disposed with spacing;

a rotating shaft rotatably mounted between the pair of side walls of the container; and a drive source for rotating the rotating shaft in a predetermined direction, wherein a blind hole circular in cross section is formed at an inner surface of one of the side walls., one end portion of the rotating shaft is rotatably inserted into the blind hole, at least one discharge groove extending beyond an open end of the blind hole longitudinally inwardly of the rotating shaft from one end of the rotating shaft is formed at an outer peripheral surface of the one end portion of the rotating shaft, at least part of said discharge groove being inclined longitudinally inwardly of the rotating shaft to an upstream side, as viewed in a rotating direction of the rotating shaft and the discharge groove is composed of an uninclined portion extending parallel to axis of the rotating shaft from the one end, and an inclined portion continued from the uninclined portion and extending longitudinally inwardly of the rotating shaft in a manner inclined to the upstream side, as viewed in the rotating direction of the rotating shaft, up to a position beyond the open end of the blind hole.

2. The combination of claim 1, wherein a plurality of the discharge grooves are formed with spacing in a circumferential direction.

3. The combination of claim 1, wherein the blind hole has an inner peripheral surface of a cylindrical shape, while the one end portion of the rotating shaft has an outer peripheral surface of a cylindrical shape.

4. The combination of claim 1, wherein a through-hole is formed in the other of the side walls, the other end portion of the rotating shaft is present extendedly through the through-hole, and the drive source is drivingly connected to a protrusion, from the other side wall, of the other end portion of the rotating shaft.

5. A combination comprising:

a container for accommodating a developer containing at least a toner, said container including a pair of side walls disposed with spacing, an entry port defined between the side walls, a delivery port defined between the side walls, and a main wall extending between the entry port and the delivery port;

a rotating shaft rotatably mounted between the pair of side walls;

a drive source for rotating the rotating shaft in a predetermined direction; and agitator/conveyor means mounted on the rotating shaft, wherein the agitator/conveyor means is composed of a flexible agitating/conveying member extending, from the rotating shaft in a radial direction of the rotating shaft, an extending length of the agitating/conveying member is greater than spacing between the rotating shaft and an inner surface of the main wall of the container, and when the rotating shaft is rotationally driven in the predetermined direction, the agitating/conveying member moves the developer from a site near the entry port toward the delivery port while rubbing the inner surface of the main wall the entry port of the container is disposed at an upper surface of the container, the delivery port of the container is disposed at a front surface of the container, a toner cartridge is removably mounted above the container, and toner accommodated in the toner cartridge is introduced into the container through the entry port, a flexible oscillating member extending rearward from its base edge extending along a front edge of the entry port is disposed, and a plurality of toner introduction openings are formed in the oscillating member, a weight is fixed to an extension edge of the oscillating member, and when the agitating/conveying member does not act on the oscillating member, an extension end portion of the oscillating member droops, and when the agitating/conveying member is caused to rotate while rubbing the oscillating member, the extension end portion of the oscillating member is moved upwards.

6. The combination of claim 5, wherein the agitating/conveying member is formed from a plastic film.

7. The combination of claim 6, wherein a plurality of openings or notches are formed in a front half, in an extending direction, of the agitating/conveying member.

8. The combination of claim 7, wherein in a rear half, in the extending direction, of the agitating/conveying member, a plurality of channel-like slits are formed with spacing in a longitudinal direction of the rotating shaft, each of said slits comprising a pair of radial slit portions extending radially of the rotating shaft with predetermined spacing in a longitudinal direction of the rotating shaft, and a longitudinal slit portion extending longitudinally of the rotating shaft between front ends of the pair of slit portions.

9. The combination of claim 6, wherein a developer detecting portion formed from a transparent or translucent material is disposed on the main wall of the container, the developer detecting portion is composed of a pair of channel-like depressed portions depressed inwardly with spacing in a longitudinal direction of the rotating shaft, developer detector means is disposed which includes a light-emitting element placed in one of the pair of depressed portions, and a light-receiving element placed in the other of the pair of depressed portions, and at least a front half, in an extending direction, of the agitating/conveying member is notched at a site thereof corresponding to the developer detecting portion.

10. The combination of claim 9, wherein the agitator/conveyor means is composed of a pair of the agitating/conveying members arranged side by side in a direction of a central axis of the rotating shaft, and inner end portions of the pair of agitating/conveying members, as viewed in the longitudinal direction of the rotating shaft, are located in correspondence with the developer detecting portion.

11. The combination of claim 9, wherein a flexible cleaning member is mounted on the rotating shaft, said flexible cleaning member being disposed upstream of the agitating/conveying member as viewed in a rotating direction of the rotating shaft, and being moved between the pair of depressed portions of the developer detecting portion.

12. The combination of claim 11, wherein the flexible cleaning member is formed from a plastic film.

13. The combination of claim 5, wherein the oscillating member is formed from a plastic film.

14. The combination of claim 5, wherein a discharge port corresponding to the entry port of the container is formed at a lower surface of the toner cartridge, a plurality of ribs are formed in the discharge port with spacing provided in a longitudinal direction of the rotating shaft, and the weight fixed to the extension edge of the oscillating member is contacted with the ribs, whereby the oscillating member is prevented from protruding upward beyond the entry port of the container.

* * * * *